United States Patent [19]

Middleton

[11] 3,994,081

[45] Nov. 30, 1976

[54] HAND-PROPELLED SNOW PLOW WITH MOTOR OSCILLATED BLADE

[76] Inventor: Carlisle A. Middleton, 38 Dungarrie Road, Baltimore, Md. 21228

[22] Filed: Sept. 12, 1975

[21] Appl. No.: 612,866

[52] U.S. Cl. ..... 37/46; 37/53; 299/14; 37/DIG. 18

[51] Int. Cl.[2] ..... E01H 5/00; E21C 37/20

[58] Field of Search ..... 37/46, 50, 53, DIG. 18, 37/141, 106, 126, 130; 173/49; 172/40, 801; 299/14

[56] References Cited

UNITED STATES PATENTS

| | | | |
|---|---|---|---|
| 1,371,064 | 3/1921 | Agneni | 37/DIG. 18 |
| 1,517,016 | 11/1924 | Relien | 37/46 |
| 2,432,780 | 12/1947 | Mader | 37/53 |
| 2,443,492 | 6/1948 | Austin | 37/141 |
| 2,690,902 | 10/1954 | Ream | 37/DIG. 18 |
| 2,725,799 | 12/1955 | Day et al. | 37/DIG. 18 |
| 3,131,878 | 5/1964 | Bodine, Jr. | 37/DIG. 18 |
| 3,443,327 | 5/1969 | Martin | 37/126 |
| 3,526,979 | 9/1970 | Ladewski | 37/46 X |
| 3,628,265 | 12/1971 | Galis | 173/49 |
| 3,898,753 | 8/1975 | Kinnunen | 37/46 |

FOREIGN PATENTS OR APPLICATIONS

| | | | |
|---|---|---|---|
| 763,274 | 7/1967 | Canada | 37/DIG. 18 |
| 824,558 | 6/1967 | Canada | 37/DIG. 18 |
| 774,588 | 5/1957 | United Kingdom | 37/DIG. 18 |

*Primary Examiner*—E. H. Eickholt
*Attorney, Agent, or Firm*—John F. McClellan, Sr.

[57] ABSTRACT

A push-type snowplow having a forwardly mounted angled blade reciprocated in a fore-and-aft direction by an oscillating motor drive for thrusting snow aside, the oscillatory impulses of the blade easing the manual effort required for snow removal; a non-jamming easy access reciprocating way system, an adjustable blade, and blade adjustment silencer are provided.

13 Claims, 3 Drawing Figures

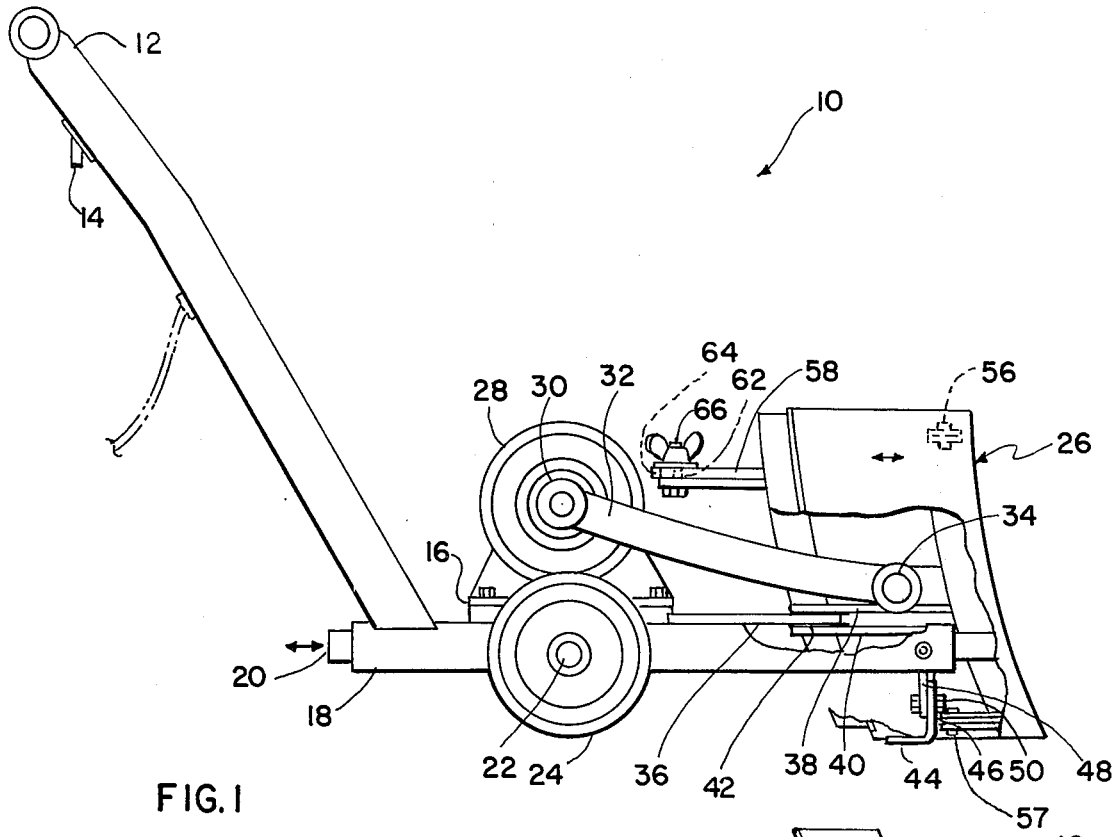
FIG. 1
FIG. 2
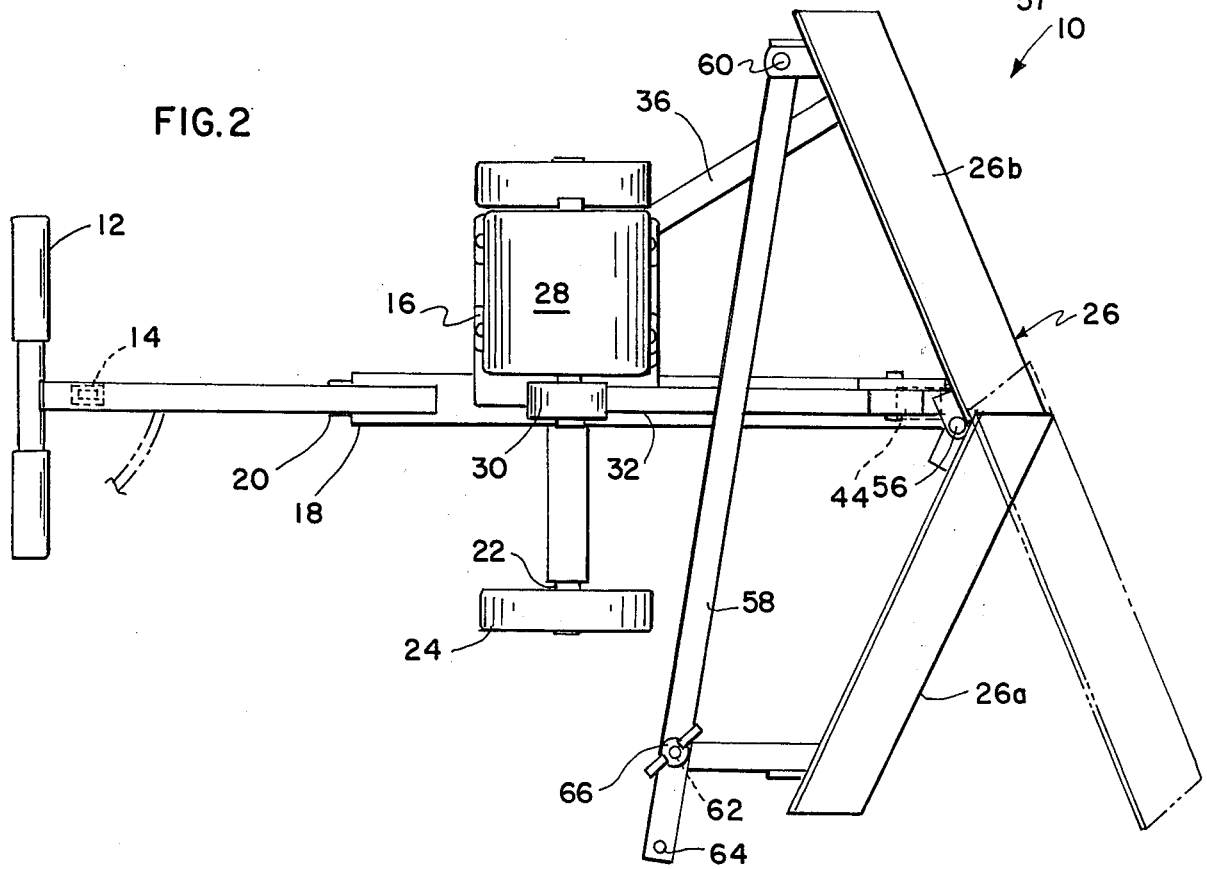

HAND-PROPELLED SNOW PLOW WITH MOTOR OSCILLATED BLADE

This invention relates generally to land vehicles and particularly to snowplows.

A principal object of the invention is to provide a manually actuated articulated-blade snowplow which reduces the effort required for snow removal by providing complete blade reciprocation through an oscillating mechanism from a power source carried by the snowplow.

Further objects are to provide a snowplow which is light in weight, easy and safe to use, compactly maneuverable, easy to store, versatile in adjustment, quiet, jam-resistant, durable and reliable in operation, and which is economical to construct and attractive in appearance.

In the prior art motor vehicle oscillating blade structure has been disclosed in the following U.S. Pat. Nos. 2,690,902 to E. H. Ream, 10- 5-54, 3,443,327 to W. E. Martin, 5-13-69, 3,571,955 to W. H. Eiger, 3-23-71, 3,628,265 to A. J. Galis, 12-21-71.

Hand-propelled two-wheel plows are known, as disclosed in U.S. Pat. No. 2,508,612 to S. H. Kimbler, granted 5-23-50.

However, to the present time it is believed that no snowplow has been provided having the combination of the advantageous features of operation and structure of the within disclosed invention.

In brief summary given for reasons of cursive description only, the invention comprises a manual-pusher type angled-front blade, wheeled frame snowplow with a fore-and-aft centrally positioned main way, a motor-driven blade reciprocating oscillatory drive, and blade stabilizing, adjusting and silencing structure.

The above and other objects and advantages of this invention will become more readily apparent on examination of the following description, including the drawings, in which like reference numerals refer to like parts:

FIG. 1 is a side elevational view partly broken away of the preferred embodiment of the invention;

FIG. 2 is a top plan view thereof; and

STRUCTURE

Figure 3:
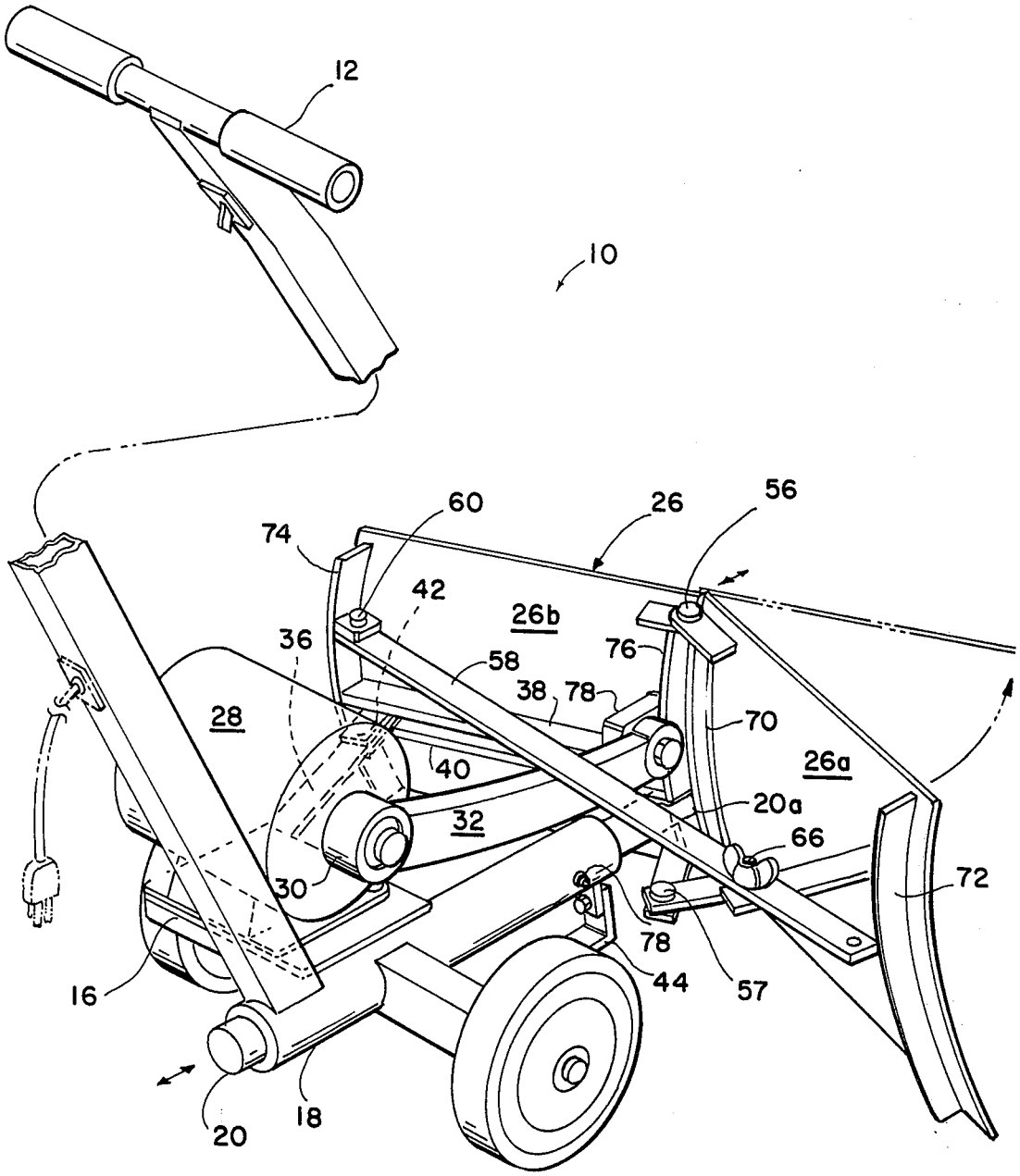
FIG. 3 is an isometric view thereof.

FIGS. 1 and 2 are described together as they show the invention 10 in aligned views.

A T-bar grip handle 12 with switch 14 proximate the grip provides for manually pushing and pulling, guiding and controlling the mechanism of the invention. The handle connects rearwardly of the snowplow frame which includes a motor mount 16, attached to a fore-and-aft way system comprising a tube 18 containing a slidable shaft 20, the whole being supported by axle structure 22 and a pair of wheeis 24 disposed on either side of the motor mount intermediate the length of the way system.

The slidable shaft of the way system is affixed at the forward end to snowplow blade 26 and supports the blade at a diagonally transverse angle to the slidable shaft.

A motor 28 carried on the motor mount, controlled by the switch and supplied by electric power either from an alternating current source(line indicated), or from a battery, not shown or alternatively gasoline powered, through the motor output shaft which rotates eccentric 30 which oscillates eccentric arm 32, which in turn reciprocates the blade in a fore-and-aft translatory direction on the way system through movable connection 34 at the blade.

The shaft 20 and the tube 18 supporting the shaft to the frame are circular in cross-section, permitting the blade to have a degree of freedom in rotation about the shaft axis, within limits set by blade constraining arm 36 located outboard of the axis of the cylindrically concentric way system elements. The blade constraining arm has the rearward end fixed to the frame and the forward end positioned to slide freely as the blade reciprocates, between upper and lower reinforcing flanges 38, 40 (FIG. 1) protruding from the back of the blade. Cushioning anti-friction inserts 42 of "Teflon" or other suitable material, preferably plastic, fixed to the flanges above and below the forward end of the blade constraining arm as by bolting or clamping, quieten and free the frictional contact between the members.

The center of the blade is supported at a constant distance above the surface being cleared of snow by a skid 44 having a rearward angle for long wear and to provide a surface for knocking the skid downward for adjustment when iced. The skid upright portion 46 (FIG. 1) is adjustably slotted and secured to a downwardly extending bracket 48 welded to the forward end of the tube 18 adjacent the blade, by adjustment bolt 50.

The blade 26 is preferably comprised of first and second blade halves, 26*a* and 26*b*, forwardly concave, tipped back to wedge under snow being plowed, and, as noted, fixed to and driven by the sliding shaft 20, and constrained in rotation by the blade constraining arm 36, all at a transverse angle to the fore-and-aft axis of the snowplow and way system.

The blade has pivot pin structure 56, 57 in the center, permitting the pivotal portion 26*a* to be swung back to form a substantially symmetrical V-shape when desired for particular snowplow operations. Holding the blade selectively in either the straight or the V-shape configuration is accomplished by means of blade adjustment link 58, which has a pivotal connection 60 (FIG. 2) to the rear of the blade end 26b constrained by the blade constraint arm 36. A pair of holes 62, 64, at different radii along the blade adjustment link hold the blade in the V-shape configuration. Attachment at the longer-radius hole location holds the blade in the straight configuration. The pivots of the blade are in vertical relation to each other, preventing pivoting from altering ground clearance of the blade.

FIG. 3 shows additional details of the structure including a blade-adjustment silencing provision in the form of a resilient strip of material 70, preferably plastic, of which polypropylene is a suitable example. Because the blade half portions are adjustable (phantom lines and arrow) the strip of material is cemented or clamped to the back of the pivotable portion 26*a* of the blade and extends through and seals the opening between it and the constrained portion 26*b*. By this means the blade halves are prevented from vibrating against each other, even though they closely overlap in the straight configuration, held on the pivot structure top and bottom, as shown, to provide smooth continuous shunting of snow to the side.

Visible also in the last Figure are blade-back constructional details including welded-on arcuate reinforcing blade-end flanges 72, 74 which respectively brace the members anchoring the ends of the blade adjustment link 58.

A similar arcuate flange 76 helps support the center of blade half 26*b*, the blade drive lug 78 to which eccentric arm 32 is forwardly pivoted, the blade pivot structure 56, and the horizontal flanges 38, 40. Additionally, the forward end 20a of the sliding shaft 20 may be bolted, or welded as shown to the central arcuate flange. This arrangement results in surprisingly close-coupled, rigid transmittal of the oscillatory drive force to the blade without doubly loading the way system. A grease fitting 78 on the forward tubular portion of the way provides means of clearing and sealing the way system while reducing friction in it by introduction of grease. Freezing or scoring of the system in made less likely in this way.

OPERATION

To clear snow, it is only necessary to push the snowplow blade against snow and follow-up by pushing easily on the handle to maintain contact as the way mounted blade oscillates (double-end arrows) thrusting the snow back and aside.

Blade oscillation amplitude of ⅛ inch (about 3mm) at about 1750 cycles/minute has been found to produce a smooth quiet vibration very effective in dry granular material removal tests simulating snow removal. Manual effort required is reduced to very little, as compared with vibrationless operation, the combination of transversely angled blade and blade reciprocation being surprisingly superior in shunting particulate material aside.

With the blade in the straight configuration the invention is effective when pulled to shunt material aside, since the reciprocation is translatory and powered on both half-cycles.

The horsepower requirement is moderate, a one-half horsepower electric motor being found entirely sufficient in the test. Part of the low effort operation is attributed to the low friction, non-binding characteristics of the cylindrical way system, externally prevented from rotating by the anti-friction pads 42 bearing on the blade constraining arm 36. Flexibility of the strap-like blade-constraining arm permits a degree of blade rotation under load without binding, since there is no alignment criticality between this arm and the way system. The location of the non-oscillating skid beneath the blade assures even clearance under varying loads, quiet operation and long wear. Excellent maneuverability is provided also. Depression of the handle which raises the blade for swinging it to either side or traversing rough ground is made easier by the mid-wheel location with the motor located above the wheel axis so that the counterbalancing weight on the handle side is increased when the unit is tipped back. The invention is very safe and simple to operate, the only powered mechanism traveling only a fraction of an inch in oscillation, produces no hazard of entanglement in the mechanism.

In conclusion, it can be seen that construction is easy, rugged and effective, without need for internal work, hidden parts or close tolerances. Welding is a good method of assembly for the fixed parts although they can be cast, and bolting for the adjustable parts. In any case, all part are accessible and easily observed. The eccentric arm bearings are preferably standard self-aligning pillow block units, the way system, frame and blade are preferably of mild steel, or aluminum fabricated from standard sizes for economy, long wear and ease of fabrication, and the motor, wheels and grips used are ordinary off-the-self items. Excess weight and bulk are avoided by the design in which the way substantially comprises the frame, and storage is thus made compact when the unit is stood upright on the blade.

This invention is not to be construed as limited to the particular forms disclosed herein, since these are to be regarded as illustrative rather than restrictive. It is therefore to be understood that the invention may be practiced within the scope of the claims otherwise than as specifically described.

What is claimed is:

1. In a snowplow having wheels supporting a frame, a handle behind the wheels for manually moving the snowplow, and a blade ahead of the wheels for plowing snow, the improvement comprising: the frame including a horizontal fore-and-aft single way system movably mounting the center of said blade at a diagonally transverse angle thereto, the handle rising at an upward angle rearwardly from angular attachment to the way system, and means on the frame for reciprocatively oscillating the blade along the way system.

2. In a snowplow as recited in claim 1, the fore-and-aft way system including cylindrically coaxial outer and inner members, whereby the blade can rotate freely about the axis thereof, and fixed means on the frame movably engaging a portion of the blade for constraining rotation of the blade.

3. In a snowplow having wheels supporting a frame, a handle behind the wheels for manually moving the snowplow, and a blade ahead of the wheels for plowing snow, the improvement comprising: the frame including a fore-and-aft way system movably mounting the blade at a diagonally transverse angle thereto, and means on the frame for reciprocatively oscillating the blade along the way system, the means for constraining rotation of the blade including a portion of the frame fixed outboard of said axis and having yielding engagement with the blade permitting oscillation of the blade.

4. In a snowplow as recited in claim 3, said portion of the frame having yielding engagement with the blade being a forwardly extending strap, and the blade being slidably engaged thereby between upper and lower horizontal flanges integral with the rearward face of the blade.

5. In a snowplow as recited in claim 4, and silencing and friction-reducing means comprising plastic material interposed between all said strap and horizontal flanges.

6. In a snowplow as recited in claim 1, the means for oscillating the blade comprising a motor affixed to the frame and having a motorshaft with an eccentric thereon, an arm having a first pivotal connection with the eccentric for oscillation thereby, and said arm having a second pivotal connection with the blade.

7. In a snowplow as recited in claim 6, all said pivotal connections comprising self-aligning bearings.

8. In a snowplow as recited in claim 7, said wheels being a laterally related pair of wheels, and the motor being affixed adjacently above the axis of said wheels, whereby rearward tip of the snowplow on the wheels to raise the blade swings the motor in a direction counterbalancing the blade.

9. In a snowplow having wheels supporting a frame, a handle behind the wheels for manually moving the snowplow, and a blade ahead of the wheels for plowing snow, the improvement comprising: the frame including a fore-and-aft way system movably mounting the blade at a diagonally transverse angle thereto, and means on the frame for reciprocatively oscillating the blade along the way system, the blade comprising first and second blade halves having pivot structure connecting the blade halves, and resilient material interposed between the blade halves at the overlap, thereby preventing the blade halves from striking when vibrating.

10. In a snowplow as recited in claim 9, the blade having means for holding the blade halves in a straight line or optionally in a V-shaped configuration, comprising a link pivoted to one of said blade halves and having means for attachment to the other of said blade halves at plural locations along the length of said link.

11. In a snowplow as recited in claim 10, the blade pivot structure being vertically aligned, whereby on blade motion about said pivot structure, clearance below the blade remains the same.

12. In a snowplow having wheels supporting a frame, a handle behind the wheels for manually moving the snowplow, and a blade ahead of the wheels for plowing snow, the improvement comprising: the frame including a fore-and-aft way system movably mounting the blade at a diagonally transverse angle thereto, and means on the frame for reciprocatively oscillating the blade along the way system, the fore-and-aft away system including cylindrically coaxial outer and inner members, whereby the blade can rotate freely about the axis thereof, means for constraining rotation of the blade, said fore-and-aft way system mounting the blade on said inner member, said outer member extending forwardly beneath the blade, and a skid attached to the outer member beneath the blade, whereby the skid is stationary relative to the frame.

13. In a snowplow as recited in claim 12, and means for adjusting the height of the skid and thereby adjusting blade clearance.

* * * * *